United States Patent [19]

Kohls

[11] Patent Number: 4,527,905

[45] Date of Patent: Jul. 9, 1985

[54] TIMER

[75] Inventor: John B. Kohls, Cincinnati, Ohio

[73] Assignee: Berkoh Company, Inc., Cincinnati, Ohio

[21] Appl. No.: 673,170

[22] Filed: Nov. 19, 1984

[51] Int. Cl.[3] ..... G04F 1/04

[52] U.S. Cl. ..... 368/93

[58] Field of Search ..... 368/93–96

[56] References Cited

U.S. PATENT DOCUMENTS

| | | | |
|---|---|---|---|
| D. 209,531 | 12/1967 | Koch | D42/7 |
| 1,124,543 | 1/1915 | Spears . | |
| 2,765,033 | 10/1956 | Uhr | 161/19 |
| 2,948,404 | 8/1960 | Harrod | 211/74 |
| 3,103,099 | 9/1963 | Hanks | 368/93 |
| 3,125,849 | 3/1964 | Wachtel | 58/144 |
| 3,438,197 | 4/1969 | Roer | 368/93 |
| 4,340,947 | 7/1982 | Barton | 368/93 |
| 4,408,894 | 10/1983 | Hemperly | 368/93 |
| 4,431,313 | 2/1984 | Hemperly | 368/93 |

*Primary Examiner*—Vit W. Miska

*Attorney, Agent, or Firm*—Wood, Herron & Evans

[57] ABSTRACT

A timer of the hourglass sand type which includes a plurality of chambers that are interconnected by conduit means. The conduit means are cooperate so that after one chamber empties a second chamber empties.

15 Claims, 2 Drawing Figures

TIMER

BACKGROUND OF THE INVENTION

Certain games require that two acts be completed within sequential time periods. For example, in the game "Trivial Pursuit" some players have adopted a rule that a contestant has forty-five seconds to consider the question. Upon the expiration of that period of time the contestant thereafter has fifteen seconds to answer the question. It is important for the contestants to be able to visually observe how much time remains. In order to insure concentration on the game a simple display of the remaining time without numbers or other distractions should be quickly apparent. It is important also that no action be required in order to start the running of the second time period. Any such action would be a distraction.

Hourglasses have long been used to signal the passage of a period of time. They are simple, yet accurate. They provide an excellent visual display of the time that has elapsed and the time that is left. They are not readily adapted for sequential timing because in order to display the passage of several periods of time a plurality of hourglasses would be required. For playing a game like "Trivial Pursuit" where the utmost concentration is required, the use of two hourglasses would be distracting and would quite likely lead to timing errors or in inaccuracies.

There are other instances where sequential timing is required and where conventional timing devices are not suitable and where a simple, inexpensive device is desirable.

It has therefore been an objective of this invention to provide an hourglass type sand timer which can be easily and cheaply manufactured and which can display the elapse of two or more time periods. It is also an important objective that such be accomplished in a sequential fashion. It is another objective that once the timer is activated it will proceed through the timing sequence without further manipulation by the player.

SUMMARY OF THE INVENTION

In its preferred embodiment the sand timer of the present invention may be generally described as follows. The sand timer comprises four chambers, interconnected in such a way that one predetermined time is measured and then a second time is measured automatically upon the completion of the first. Two chambers are primary chambers and are positioned one above the other. The other two chambers, secondary chambers, are also positioned one above the other and adjacent to the primary chambers. The secondary chambers are of smaller volume than the primary chambers. Sand may pass from the upper primary chamber into the lower primary chamber by passing through an orifice. Sand in the upper secondary chamber can flow into the upper primary chamber through a passageway. Another passageway also permits sand to flow between the lower primary and secondary chambers. The size of the orifice and passageways are selected so as to insure a sequential action of the timer, that is, with sand in the upper primary and secondary chambers, sand first flows out of the primary upper chamber into the primary lower chamber through the orifice. Thereafter sand exits the upper secondary chamber through the passageway, into the adjacent upper primary chamber, through the orifice and then through the other passageway into the lower secondary chamber. One time is measured by the emptying of the upper primary chamber or the filling of the lower primary chamber, the other time is thereafter measured by the emptying of the upper secondary chamber or the filling of the lower secondary chamber. The sizes of the chambers are selected to coincide with the time periods desired.

DESCRIPTION OF THE PREFERRED EMBODIMENT

Figure 1:
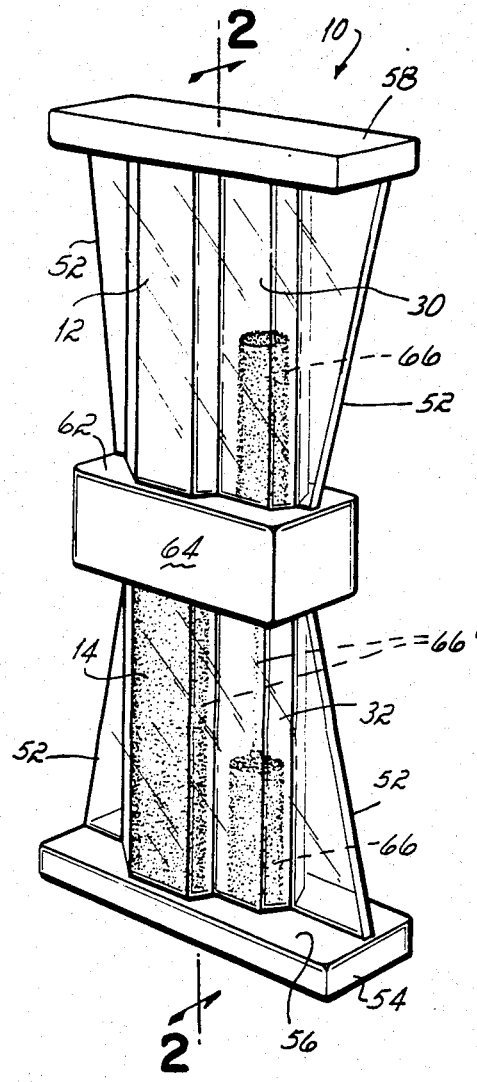
FIG. 1 is a perspective view of the timer of the present invention showing the lower primary chamber filled with sand and the lower secondary chamber filling with sand.
Figure 2:
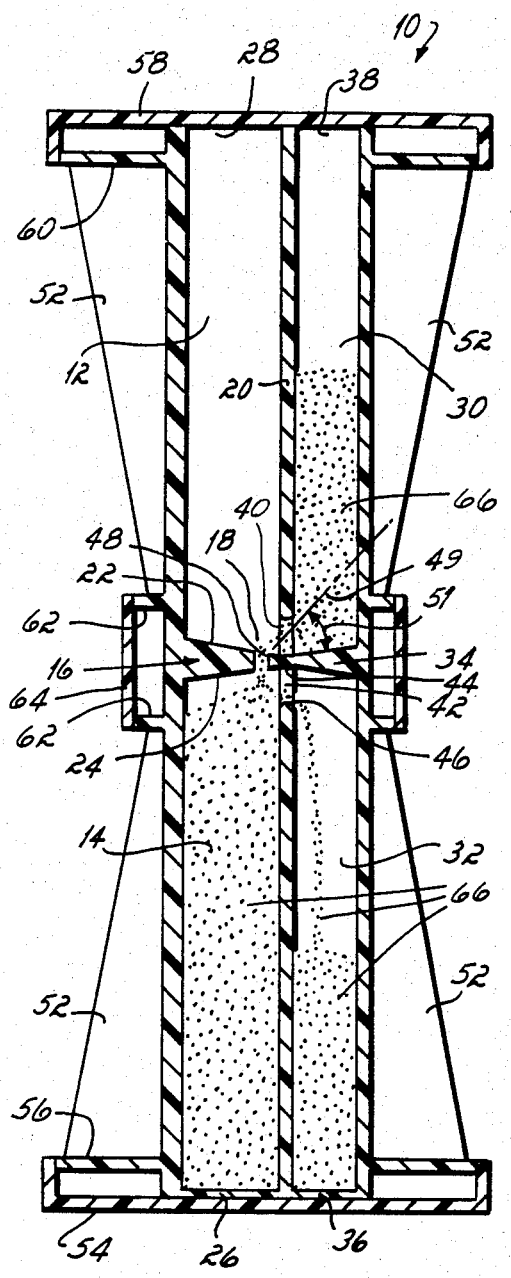
FIG. 2 is a view taken along lines 2—2 of FIG. 1.

Referring to FIG. 1 and FIG. 2 the sand timer 10 of the present invention will now be described. The sand timer 10 has two primary chambers 12 and 14, one being an upper primary chamber 12 and the other being a primary lower chamber 14. The inside of the primary chambers 12 and 14 are cylindrical and have the same diameter. As shown the diameters are about 0.625 inches. The average length of each chamber is about 3.33 inches. A separation wall 16 having an orifice 18 therethrough provides an opening between the upper and lower primary chambers 12 and 14. The diameter of the orifice 18 is about 0.093 inches. It is off center with respect to the axial center of the upper and lower primary chambers 12 and 14. The edge of the orifice 18 is spaced from the edge of the side wall 20 by about 0.079 inches. Separation wall 16 is tapered toward the orifice 18 on both its top surface 22 and bottom surface 24 to assist in preventing sand from accumulating on the separation wall 16 during use. In addition to the elements just described the primary chambers 12 and 14 also include a bottom wall 26 and a partially open end 28.

Positioned adjacent to the primary chambers are two secondary chambers 30 and 32, one an upper secondary chamber 30 and the other a lower secondary chamber 32. A wall 34 separates the two chambers 30 and 32. The chambers are cylindrical and each has a diameter of about 0.360 inches and an average length of about 3.362 inches. The lower secondary chamber 32 includes a bottom wall 36. The upper secondary chamber 30 has a partial opening 38 at the top. The upper and lower secondary chambers 30 and 32 have as one of their side walls the same side wall 20 as the upper and lower primary chambers 12 and 14.

Between upper secondary chamber 30 and upper primary chamber 12 is an upper passageway 40 in side wall 20. Between lower primary chamber 14 and lower secondary chamber 32 is a lower passageway 42 in side wall 20. The cross-sectional areas of the passageways 40 and 42 are equal and are selected so that a portion of each, described below, is greater than the cross-sectional area of the orifice 18 as more particularly described below. The distance from point 44 to point 46 is about 0.204 inches. The corresponding distance of upper passageway 40 is likewise about 0.204 inches. The thickness of side wall 20 is about 0.130 inches. The upper passageway 40 and lower passageway 42 terminate at the connection of wall 16 and wall 34. The height, point 44 to point 46, and the corresponding dimension in the upper secondary chamber 30 and the thickness of the side wall 20 must be such that an imaginary 49 line drawn from the outward point 48 of the wall 16 at an angle 51 greater than the angle of repose of the particulate material, if extended, would pass through the passageways 40 and 42 and create a cross-sectional area above the imaginary line greater than orifice 18. For the particulate material or sand described below an acceptable angle would be 45° which is greater than the angle of repose of the particular sand employed which is about 35°. As used herein angle of repose is the maximum angle with the horizontal at which the particulate material may be piled before the material slides.

The chambers 12, 14, 30 and 32 may be injection molded from a suitable plastic, as for example general purpose polystyrene. Two halves can be formed and then joined together by a suitable means such as ultrasonic bonding. A plane extending down through the middle of the timer perpendicular to lines 2—2 in FIG. 1 define the two halves. For aesthetic purposes, fins 52 can be integrally molded with the halves.

A rectangular bottom cap 54 surrounds the rectangular base 56 and is adhesively secured thereto. Similarly a rectangular top cap 58 surrounds the rectangular base 60 at the top and is secured thereto. If desired, the middle of the timer 10 may have two radial flanges 62 that extend outwardly to which a two part cover 64 may be secured.

Prior to the time that the top cap 58 is affixed to the timer 10, sand 66 or some other particulate material is placed in the timer through openings 28 and 38 so that the two upper chambers 12 and 14 are almost filled. Washed white Ottawa F-70 sand has been found to be suitable. Whatever particulate material is selected the angle of repose should be determined so that the size of the passageways can be determined accordingly.

A cycle of operation of the timer proceeds as follows. Sand 66 almost fills the upper primary chamber 12 and the upper secondary chamber 30. No appreciable amount of sand 66 is in either lower chamber 14 or 32. The sand 66 first flows from the upper primary chamber 12 through orifice 18 and into the lower primary chamber 14. The positionment and size of the orifice 18 and lower passageway 40 are such that the sand will not enter the lower secondary chamber 32 until the lower primary chamber 14 is filled. The sand in the upper secondary chamber 30 does not begin to flow through the upper passageway 40 until such time as upper primary chamber 12 is emptied. At this point a predetermined time has elapsed. The sand then flows from the upper secondary chamber through the passageway 40, the orifice 18 and enters the lower primary chamber 14. Because chamber 14 is already filled with sand 66 to a level up to the lower passageway 42 it is diverted into lower secondary chamber 32 where it continues to flow until the sand 66 from upper secondary chamber 30 is emptied. At this point the second predetermined time has ended.

The dimensions given above were selected so that during an operating cycle it takes approximately 45 seconds for the upper primary chamber 12 to empty. Upper secondary chamber 30 then begins to empty and continues until approximately 15 seconds have elapsed when it too is emptied.

After the bottom chambers 14 and 32 have filled the cycle can be repeated by inverting the timer 10 so that the bottom chambers 14 and 32 in effect become the upper chambers 12 and 30. The sequence described above would then be repeated.

From the foregoing one skilled in the art will appreciate that different sizes of chambers 12, 14, 30 and 32, different orifice 18 sizes, sand grain sizes, can be employed in order to vary the times measured. Also, variations using more than four chambers are possible if one desires to display the elapse of three or more periods of time. Likewise the chambers need not be arranged in parallel fashion as illustrated but could be arranged as spokes on a wheel. The chambers can be separated and do not require common side walls 20. If such a variant is made the length of passageways 40 and 42 will be greater than the thickness of the side wall. Their angle or slant must be selected so as to be greater than the angle of repose of the sand to insure that the sand can slide down the tube. All of the foregoing variants, and others that will be readily apparent to one of ordinary skill, are within the scope of the present invention.

What is claimed is:

1. A timer comprising at least two upper chambers and two lower chambers for containing a particulate material, conduit means connecting said upper chambers with said lower chambers to direct the particulate material first to fill one of said lower chambers and then to direct the particulate material to a second lower chamber.

2. The timer of claim 1 wherein the conduit means includes at least one passageway connecting at least two upper chambers and at least one passageway connecting at least two lower chambers whereby particulate material can flow between at least two upper chambers and at least two lower chambers.

3. The timer of claim 2 wherein at least one upper chamber is positioned above a lower chamber and an orifice is in between.

4. The timer of claim 2 wherein there are two upper chambers and two lower chambers with said upper chambers positioned above said lower chambers and an orifice permits particulate material to pass between an upper chamber and a lower chamber.

5. The timer of claim 4 wherein the cross-sectional area of each passageway above the angle of repose is greater than the cross-sectional area of the orifice.

6. The timer of claim 5 wherein the upper chamber and the lower chamber over which it is positioned and in direct access to said orifice have a similar cylindrical cross sections and their volume is greater than the other two secondary chambers.

7. The timer of claim 6 wherein the particulate material is sand.

8. A timer comprising primary upper and lower chambers for containing a particulate material, said primary chambers each having a side wall, an orifice connecting said upper and lower chambers, secondary upper and lower chambers for containing a particulate material, said secondary chambers each having a side wall adjacent to the side wall of said primary chambers, passageways through said side walls permitting particulate material to flow between the upper secondary chamber and the upper primary chamber and from said lower primary chamber into said lower secondary chamber.

9. The timer of claim 8 wherein the two passageways have about the same cross-sectional area and wherein the cross-sectional area of each passageway above the angle of repose is greater than the cross-sectional area of said orifice.

10. The timer of claim 9 wherein the volume of the primary chambers is greater than the volume of the secondary chambers.

11. The timer of claim 10 having a particulate material therein.

12. The timer of claim 11 wherein the particulate material is sand and is present in a quantity less than the combined volume of a primary and secondary chamber.

13. The timer of claim 12 wherein base means are provided.

14. The timer of claim 13 wherein the chambers are made from a transparent material.

15. The timer of claim 9 wherein the passageways are adjacent to said orifice.

* * * * *